United States Patent [19]

Klute et al.

[11] 4,429,618

[45] Feb. 7, 1984

[54] HYDRAULIC ROLL-ADJUSTMENT APPARATUS

[75] Inventors: Friedrich Klute, Kreuztal; Robert Fender, Essen, both of Fed. Rep. of Germany

[73] Assignee: Fried. Krupp Gesellschaft mit beschränkter Haftung, Essen, Fed. Rep. of Germany

[21] Appl. No.: 265,441

[22] Filed: May 20, 1981

[30] Foreign Application Priority Data

May 24, 1980 [DE] Fed. Rep. of Germany ..... 3019947

[51] Int. Cl.[3] ..... F01B 25/26; F01B 7/20

[52] U.S. Cl. ..... 91/1; 91/519; 91/535; 92/62; 92/107; 92/117 A

[58] Field of Search ..... 91/216 R, 519, 534, 91/535, 536, 217, 1; 92/51, 62, 65, 66, 107, 108, 117 R, 117 A, 5 R

[56] References Cited

U.S. PATENT DOCUMENTS

| | | | |
|---|---|---|---|
| 2,456,403 | 12/1948 | Goehring | 92/5 R |
| 2,619,695 | 12/1952 | Young | 92/117 R |
| 2,642,138 | 6/1953 | Macewka | 92/51 |
| 2,649,693 | 8/1953 | Venus | 91/519 |
| 2,893,519 | 7/1959 | Martin | 92/107 |
| 3,094,900 | 6/1963 | Wandel et al. | 92/51 |
| 3,563,136 | 2/1971 | Valente | 91/519 |
| 4,316,597 | 2/1982 | Goodman et al. | 92/108 |

FOREIGN PATENT DOCUMENTS

| | | | |
|---|---|---|---|
| 2325208 | 5/1973 | Fed. Rep. of Germany . | |
| 1193214 | 2/1956 | United Kingdom . | |
| 862743 | 8/1968 | United Kingdom . | |
| 1282101 | 7/1972 | United Kingdom | 92/62 |
| 1441488 | 6/1976 | United Kingdom . | |
| 144089 | 1/1962 | U.S.S.R. | 91/536 |

OTHER PUBLICATIONS

Hydraulische Walzenanstellungen für bessere Kaltbandtoleranzen, pp. 908–911, 10/1979.

*Primary Examiner*—Robert E. Garrett
*Assistant Examiner*—Richard S. Meyer
*Attorney, Agent, or Firm*—Karl F. Ross; Herbert Dubno

[57] ABSTRACT

A hydraulic adjustment apparatus as is for instance used to adjust a roller of a rolling mill has a cylinder forming a first cylinder chamber and having a first cylinder surface directed backwardly in a predetermined direction in the first chamber. A first piston is displaceable forwardly and backwardly in the direction in the first chamber relative to the cylinder and has in this chamber a forwardly directed first piston face of a predetermined first piston area. The first piston is formed with at least one second chamber receiving a forwardly and backwardly displaceable second piston having a forwardly directed end engageable with the first chamber surface. This second piston in turn has a second piston face of a predetermined second piston area substantially smaller than the first piston area and directed backwardly in the second chamber. A liquid under high pressure can be fed alternately to the first and second chambers so that when the first chamber is pressurized the first piston and cylinder will be urged apart with a relatively great force, and when the second chamber is pressurized they will be urged apart with a substantially smaller force.

5 Claims, 2 Drawing Figures

HYDRAULIC ROLL-ADJUSTMENT APPARATUS

FIELD OF THE INVENTION

The present invention relates to a hydraulic roll-adjustment apparatus. More particularly this invention concerns such an apparatus used to bias a roll in a roll mill toward the opposing roll.

BACKGROUND OF THE INVENTION

It is known in a rolling mill to brace one or both of the rolls in the respective stands by means of hydraulic adjustment mechanisms which are capable of exerting considerable force between the respective stand and the roller in a direction perpendicular to the roll rotation axis.

A standard such arrangement comprises a massive piston that is normally fixed on the traverse of the rolling-mill frame, and a cylinder surrounding this piston and engaged with the roll-carrying block. The chamber formed between this piston and its cylinder can be pressurized with a liquid under very high pressure so as to be able to exert the considerable force necessary in a rolling mill. Not only is the force with which the adjustment mechanism operates directly proportional to the pressure of the liquid, but in addition the speed with which the adjustment mechanism can operate is also proportional to this pressure.

The problem with these devices is that it is frequently necessary to exert a substantially reduced pressure, frequently only about 75% of the normal high pressure used. This is necessary when the rollers must not be urged together with too great a force. The disadvantage during this type of operation is, however, that adjustment speed is correspondingly reduced.

OBJECTS OF THE INVENTION

It is therefore an object of the present invention to provide an improved hydraulic adjustment mechanism.

Another object is to provide such a mechanism which operates rapidly and effectively even when only exerting a relatively limited force as is necessary in certain applications.

SUMMARY OF THE INVENTION

These objects are attained according to the instant invention by forming in the first or main piston of the cylinder a second chamber, distinguished from the first chamber in which the first piston is reciprocal relative to the cylinder, and providing in this second chamber a second piston having an effective surface area which is substantially smaller than that of the first piston. This second piston has a rear end which is engageable with a cylinder surface of the first cylinder chamber and a front end which is exposed in the second chamber. Thus when the first chamber is pressurized with a relatively high pressure the arrangement will be able to exert a relatively high pressure and will operate at relatively high speed. When the second chamber is pressurized with the same pressure, however, the system will exert considerably less force, but will still operate with the same high speed as when the first cylinder chamber was pressurized.

Thus with the system according to the instant invention it is possible to have the same high adjustment speed which one obtains with high pressure, even while the adjustment apparatus is set up so as to exert a substantially lower force.

According to further features of this invention the second piston may be constituted as a plurality of such second pistons arranged in an annular array, angularly equispaced within the array, and centered on the center of the first piston. The combined surface area of the second pistons is smaller than the first piston area. This effect can also be achieved according to the instant invention by making the second chamber and piston annular and centered on the center of the first piston. Either way the force exerted by the second piston or pistons on the cylinder will be centered on the center of the piston, so as not to cant the piston in its cylinder.

It is also possible according to this invention to form the first piston with a third chamber extending in the displacement direction. The apparatus comprises a third piston fixed to the cylinder and engaged in this third chamber. This third piston has a forwardly directed third piston face in the third chamber and the pressurized means is connected to the third chamber to pressurize same with the fluid at the high pressure. Such a third piston constitutes a return piston and allows the extended piston-and-cylinder arrangement according to the instant invention to be returned to its short or non-extended position very easily.

According to another feature of this invention this third piston has a stem extending all the way through the primary piston and having an exposed end. A position detector connected to this exposed end can give a direct readout of the exact relative positions of the main cylinder and piston.

SPECIFIC DESCRIPTION

Figures 1, 2:
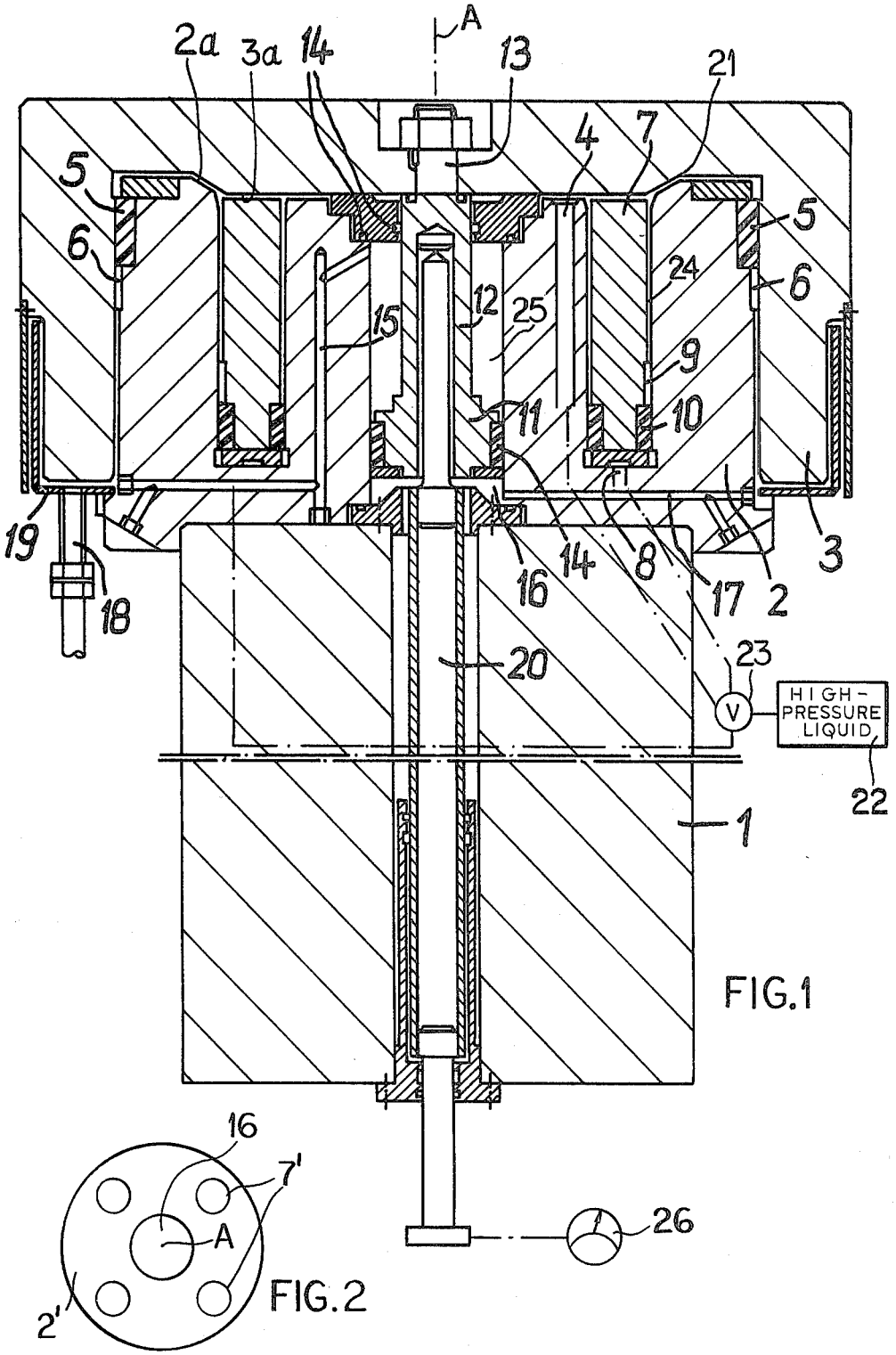
FIG. 1 is an axial section, partly in schematic form, through the adjustment apparatus according to this invention.
FIG. 2 is a small-scale end view of a variation of the arrangement of FIG. 1.

As seen in FIG. 1 a fixed support 1 which may be constituted by or be fixed on the traverse or window of a roller-support stand carries at its upper side a cylindrical member 2 centered on an upright axis A. Because this member functions both as a piston and a cylinder it may be referred to hereinafter as piston/cylinder 2. A movable cylinder 3 snugly surrounds this piston/cylinder 2 and defines therewith a first cylinder chamber 21 between its lower surface 3*a* and the upper surface 2*a* of the piston/cylinder 2. This chamber 21 can be pressurized through a hydraulic line 4 from a source 22 of liquid under very high hydraulic pressure, this source 22 being connected to the line 4 through a four-port valve 23. A seal 5 and a guide 6 are provided to prevent leakage from the chamber 21 and to ensure proper centering of the piston/cylinder 2 in the cylinder 3.

The member 2 is formed with an annular blind bore forming a second chamber 24 centered on the axis A and receiving an annular piston 7 having an upper end engageable with the surface 3*a* of the cylinder 3 and a lower end provided with a guide 9 and seals 10. This chamber 24 can be pressurized through a hydraulic line 8 also connected through the valve 23 to the high-pressure source 22.

The effective surface area of the piston/cylinder 2 is much greater than that of the piston 7. Thus, even though the respective chambers will be pressurized with fluid at the same pressure, the force exerted by the piston 7 will be much less than that exerted by the piston/cylinder 2. Nonetheless, the adjustment speed will be the same.

In addition a third return piston 11 has a piston rod 12 fixed by means of a bolt 13 to the cylinder 3 and is also centered on the axis A. A ring 14 screwed into the piston/cylinder 2 forms a chamber 25 between the upper surface of the piston 11 and the piston/cylinder 2, but obviously pressurization of this chamber 25 will move the support 1 and piston/cylinder 2 together rather than apart. The high-pressure source 22 is connected through the valve 23 and a hydraulic line 15 to this chamber 25 also. The effective surface area of this piston 11 is substantially smaller than that of the piston 7.

The piston 11 is formed with a tubular extension 20 which extends all the way through the support 1 and which is connected below this support 1 with a position detector 26. In this manner it is a relatively simple matter at any time to read the exact position of the piston 2 relative to the piston/cylinder 2.

Extending radially out of the lower end of the chamber 25 beneath the piston 11 is a leak passage 17 which opens at a leak-trapping skirt 19 from which leads a leak drain line. Thus any leakage from any of the chambers 21, 24, or 25 will be caught and conducted away.

The valve 23 is of the type which can connect its high-pressure side to any one of its three low-pressure side connections, but which cannot connect to all of these connections at the same time. Hence the high pressure of the source will be used for all of the various piston and cylinder combinations.

FIG. 2 shows how a piston 2' can be provided with an annular array of separate pistons 7' all of cylindrical shape and angularly equispaced about the axis A. The chambers of these pistons 7' would all be connected together for simultaneous pressurization. Thus this arrangement would function in a manner identical to that of FIG. 1, with the pistons 7' doing the job of the piston 7.

The advantage of the system according to the instant invention is that the force exerted by the adjustment apparatus can be varied without varying the adjustment speed. Not only does this in itself represent a considerable advantage, but it makes it possible to eliminate the complicated and costly pressure-adjusting systems required by the prior-art systems.

I claim:

1. A hydraulic adjustment apparatus for use in a roll stand, the apparatus comprising:

a cylinder forming a first cylinder chamber and having a first cylinder surface directed backward in a predetermined direction in said first chamber;

a first piston displaceable relative to the cylinder forward and backward in said direction in said first chamber and having in said chamber a forwardly directed first piston face of a predetermined first piston area, said first piston being formed with at least one second chamber open forward in said direction at said first face;

a second piston displaceable forward and backward in said direction in said second chamber and having a forwardly directed end engageable with said first cylinder surface and a second piston face of a predetermined second piston area substantially smaller than said first piston area and directed backward in said second chamber;

means for alternately pressurizing said chambers at the respective piston faces in any relative axial position of said pistons and cylinder with liquid under substantially the same high pressure, whereby when said second chamber is thus pressurized said first piston and cylinder will be urged apart with substantially less force than when said first chamber is thus pressurized, said first piston being formed with a third chamber extending in said direction; and a third piston fixed to said cylinder and engaged in said third chamber, said third piston having a forwardly directed third piston face in said third chamber, said means being connected to said third chamber to pressurize same with said fluid at said high pressure.

2. The apparatus defined in claim 1 wherein said first piston is formed with a plurality of such second chambers each provided with a respective such second piston, said means being connected to all of said second chambers for simultaneous pressurization of same, the combined surface areas of said second pistons being smaller than said first piston area.

3. The apparatus defined in claim 2 wherein said second pistons and chambers are arranged in an annular array and are angularly equispaced about the center of said first piston.

4. The apparatus defined in claim 1 wherein said second chamber and piston are annular and centered on the center of said first piston.

5. The apparatus defined in claim 1 wherein said third piston has a stem extending all the way through said primary piston and having an exposed end, said apparatus further comrising a position detector connected to said exposed end.

* * * * *